US008061269B2

(12) United States Patent
Bass et al.

(10) Patent No.: US 8,061,269 B2
(45) Date of Patent: Nov. 22, 2011

(54) MULTILAYER STENCILS FOR APPLYING A DESIGN TO A SURFACE

(75) Inventors: Benjamin A. Bass, Oak Creek, WI (US); Benjamin N. Shiffler, Union Grove, WI (US); Ketan N. Shah, Gumee, IL (US); James F. Kimball, Greenfield, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 710 days.

(21) Appl. No.: 12/152,405

(22) Filed: May 14, 2008

(65) Prior Publication Data

US 2009/0282993 A1 Nov. 19, 2009

(51) Int. Cl.
*B41N 1/24* (2006.01)

(52) U.S. Cl. ..... 101/127; 101/128.21

(58) Field of Classification Search ..... 101/127, 101/128.21; 118/301, 213; *B41N 1/24*
See application file for complete search history.

(56) References Cited

U.S. PATENT DOCUMENTS

| | | | |
|---|---|---|---|
| 2,802,713 | A | 8/1957 | Olpin et al. |
| 2,959,461 | A | 11/1960 | Murray |
| 3,030,227 | A | 4/1962 | Clifford et al. |
| 3,236,586 | A | 2/1966 | Humphreys |
| 3,377,412 | A | 4/1968 | Franks |
| 3,486,929 | A | 12/1969 | Anspon et al. |
| 3,595,166 | A | 7/1971 | Sherman |
| 3,652,198 | A | 3/1972 | Farber et al. |
| 3,663,262 | A | 5/1972 | Cogan |
| 3,716,330 | A | 2/1973 | Kitamura et al. |
| 3,723,323 | A | 3/1973 | Morgan et al. |
| 3,821,066 | A | 6/1974 | Tillotson et al. |

(Continued)

FOREIGN PATENT DOCUMENTS

DE 2122 714 10/1972

(Continued)

OTHER PUBLICATIONS

Final office action mailed on Dec. 17, 2008 for U.S. Appl. No. 11/447,694 citing Budden.

(Continued)

*Primary Examiner* — Leslie J Evanisko

(57) ABSTRACT

Compositions, methods, apparatuses, kits, and combinations are described for permanently or temporarily re-designing, decorating, and/or re-coloring a surface. In one embodiment, a stencil is provided that has an embossed top layer and a low-slip bottom layer that has a static coefficient of friction between about 0.2 to about 1.2 and/or a kinetic coefficient of friction that is between about 0.1 to about 1.1 as measured against another surface having the same bottom surface as the stencil. Compositions useful in the present disclosure include a décor product that is formulated to be applied and affixed to a surface. If desired, the décor product may be substantially removed from the surface before being affixed thereto. If a user desires to remove the décor product, the décor product is formulated to be removed by a number of methods including, for example, vacuuming, wet extraction, chemical application, and the like. If the user desires to affix the décor product to the surface in a permanent or semi-permanent manner, the décor product may be affixed to the surface by applying energy thereto in the form of, for example, heat, pressure, emitted waves, an emitted electrical field, a magnetic field, and/or a chemical. The décor product may also be utilized in the form of a kit or in conjunction with a design device, such as a stencil, to control the application of the décor product to create, for example, a pattern on the surface.

17 Claims, 3 Drawing Sheets

U.S. PATENT DOCUMENTS

| | | | |
|---|---|---|---|
| 3,849,159 | A | 11/1974 | Palmer et al. |
| 3,861,869 | A | 1/1975 | Schwindt et al. |
| 3,867,171 | A | 2/1975 | Ellsworth |
| 3,904,358 | A | 9/1975 | James |
| 3,910,848 | A | 10/1975 | Froehlich et al. |
| 3,929,068 | A | 12/1975 | Budden |
| 3,945,791 | A | 3/1976 | Bohrn |
| 3,963,820 | A | 6/1976 | Blakey |
| 3,988,521 | A | 10/1976 | Fumel et al. |
| 4,006,273 | A | 2/1977 | Wolinski et al. |
| 4,013,594 | A | 3/1977 | Froehlich et al. |
| 4,016,327 | A | 4/1977 | Fumei et al. |
| 4,046,505 | A | 9/1977 | Cobb et al. |
| 4,085,159 | A | 4/1978 | Marsiat |
| 4,089,722 | A | 5/1978 | Holoubek |
| 4,093,415 | A | 6/1978 | Defago et al. |
| 4,129,669 | A | 12/1978 | Lopez |
| 4,131,422 | A | 12/1978 | Thomas et al. |
| 4,131,424 | A | 12/1978 | Cocoros et al. |
| 4,140,728 | A | 2/1979 | Hahn et al. |
| 4,147,508 | A | 4/1979 | Perrig |
| 4,147,737 | A | 4/1979 | Sein et al. |
| 4,180,527 | A | 12/1979 | Schmid et al. |
| 4,195,140 | A | 3/1980 | Sexsmith et al. |
| 4,239,490 | A | 12/1980 | Kelly et al. |
| 4,243,565 | A | 1/1981 | Nishino et al. |
| 4,263,352 | A | 4/1981 | Kaltenbach et al. |
| 4,286,959 | A | 9/1981 | Horn et al. |
| 4,293,596 | A | 10/1981 | Furendal et al. |
| 4,397,650 | A | 8/1983 | Gregorian et al. |
| 4,434,198 | A | 2/1984 | Clark |
| 4,468,230 | A | 8/1984 | Thomas et al. |
| 4,471,108 | A | 9/1984 | Belder et al. |
| 4,476,976 | A | 10/1984 | Smith |
| 4,502,867 | A | 3/1985 | Reinhardt |
| 4,522,864 | A | 6/1985 | Humason et al. |
| 4,545,481 | A | 10/1985 | Smith |
| 4,560,604 | A | 12/1985 | Shimizu et al. |
| 4,568,606 | A | 2/1986 | Hart et al. |
| 4,604,308 | A | 8/1986 | Widmer et al. |
| 4,681,791 | A | 7/1987 | Shibahashi et al. |
| 4,702,742 | A | 10/1987 | Iwata et al. |
| 4,713,084 | A | 12/1987 | Bohrn et al. |
| 4,726,976 | A | 2/1988 | Karami et al. |
| 4,778,742 | A | 10/1988 | Ong et al. |
| 4,782,672 | A | 11/1988 | Secolo |
| 4,836,828 | A | 6/1989 | Hussamy |
| 4,871,604 | A | 10/1989 | Hackler |
| 4,913,952 | A | 4/1990 | Fowler |
| 4,960,433 | A | 10/1990 | Renton |
| 4,965,172 | A | 10/1990 | Matrick |
| 4,978,390 | A | 12/1990 | Snedeker |
| 4,981,488 | A | 1/1991 | Cates et al. |
| 4,985,115 | A | 1/1991 | De Rossett, Jr. |
| 4,990,369 | A | 2/1991 | Burchill et al. |
| 5,010,131 | A | 4/1991 | Wagner |
| 5,041,488 | A | 8/1991 | Meades |
| 5,047,261 | A | 9/1991 | Moussa et al. |
| 5,057,392 | A | 10/1991 | McCabe et al. |
| 5,064,443 | A | 11/1991 | Ricci |
| 5,071,440 | A | 12/1991 | Hines et al. |
| 5,091,213 | A | 2/1992 | Silbermann et al. |
| 5,091,257 | A | 2/1992 | Nonogaki et al. |
| 5,098,497 | A | 3/1992 | Brinley |
| 5,110,317 | A | 5/1992 | Hangey et al. |
| 5,110,625 | A | 5/1992 | Burchill et al. |
| 5,110,626 | A | 5/1992 | Burchill et al. |
| 5,110,634 | A | 5/1992 | Silbermann et al. |
| 5,112,678 | A | 5/1992 | Gay et al. |
| 5,112,715 | A | 5/1992 | DeMejo et al. |
| 5,112,883 | A | 5/1992 | Gallas |
| 5,116,243 | A | 5/1992 | Wills |
| 5,122,404 | A | 6/1992 | Fowler |
| 5,124,519 | A | 6/1992 | Roy et al. |
| 5,126,191 | A | 6/1992 | Fourezon |
| 5,131,914 | A | 7/1992 | Kelley |
| 5,131,918 | A | 7/1992 | Kelley |
| 5,143,754 | A | 9/1992 | Long et al. |
| 5,147,747 | A | 9/1992 | Wilson et al. |
| 5,164,226 | A | 11/1992 | Burchill et al. |
| 5,176,745 | A | 1/1993 | Moore et al. |
| 5,193,457 | A | 3/1993 | Hahn |
| 5,199,957 | A | 4/1993 | Pascoe |
| 5,217,255 | A | 6/1993 | Lin et al. |
| 5,232,535 | A | 8/1993 | Brinley |
| 5,238,465 | A | 8/1993 | Fritzsche |
| 5,242,994 | A | 9/1993 | Nield et al. |
| 5,243,906 | A | 9/1993 | Okusawa |
| 5,245,932 | A | 9/1993 | Ujiie |
| 5,250,634 | A | 10/1993 | Toyoda et al. |
| 5,252,379 | A | 10/1993 | Kuribayashi et al. |
| 5,258,471 | A | 11/1993 | Nield et al. |
| 5,262,510 | A | 11/1993 | Kwon et al. |
| 5,284,902 | A | 2/1994 | Huber et al. |
| 5,298,035 | A | 3/1994 | Okamoto |
| 5,302,223 | A | 4/1994 | Hale |
| 5,303,647 | A | 4/1994 | Seo et al. |
| 5,321,063 | A | 6/1994 | Shimada et al. |
| 5,330,627 | A | 7/1994 | Grütter et al. |
| 5,353,701 | A | 10/1994 | Casagrande |
| 5,355,793 | A | 10/1994 | Sato |
| 5,358,537 | A | 10/1994 | Kelly et al. |
| 5,362,415 | A | 11/1994 | Egraz et al. |
| 5,362,417 | A | 11/1994 | Ziolo |
| 5,374,687 | A | 12/1994 | Cooperman et al. |
| 5,379,947 | A | 1/1995 | Williams et al. |
| 5,389,108 | A | 2/1995 | Fritzsche et al. |
| 5,409,772 | A | 4/1995 | Yabusa et al. |
| 5,415,090 | A | 5/1995 | Natori et al. |
| 5,417,156 | A | 5/1995 | Tateishi et al. |
| 5,453,459 | A | 9/1995 | Roberts |
| 5,456,725 | A | 10/1995 | Bruhnke |
| 5,460,087 | A | 10/1995 | Ogorzalek |
| 5,460,881 | A | 10/1995 | Hsu |
| 5,462,996 | A | 10/1995 | Portelli et al. |
| 5,466,527 | A | 11/1995 | Jenkins |
| 5,472,764 | A | 12/1995 | Kehr et al. |
| 5,483,883 | A | 1/1996 | Hayama |
| 5,490,866 | A | 2/1996 | Guth |
| 5,498,464 | A | 3/1996 | Ikejima et al. |
| 5,514,462 | A | 5/1996 | Endo et al. |
| 5,522,313 | A | 6/1996 | Okusawa |
| 5,525,125 | A | 6/1996 | Cole et al. |
| 5,536,762 | A | 7/1996 | Hinojosa |
| 5,542,351 | A | 8/1996 | Roth |
| 5,571,444 | A | 11/1996 | Fisher et al. |
| 5,575,877 | A | 11/1996 | Hale et al. |
| 5,576,361 | A | 11/1996 | Craun |
| 5,578,245 | A | 11/1996 | Ziolo |
| 5,587,408 | A | 12/1996 | Burns et al. |
| 5,589,256 | A | 12/1996 | Hansen et al. |
| 5,601,023 | A | 2/1997 | Hale et al. |
| 5,603,735 | A | 2/1997 | Zimin, Sr. et al. |
| 5,626,634 | A | 5/1997 | Goldmann et al. |
| 5,630,850 | A | 5/1997 | Schafflutzel et al. |
| 5,637,654 | A | 6/1997 | Panandiker et al. |
| 5,640,180 | A | 6/1997 | Hale et al. |
| 5,645,609 | A | 7/1997 | Andrean et al. |
| 5,646,240 | A | 7/1997 | Oishi et al. |
| 5,655,446 | A | 8/1997 | Watanabe |
| 5,669,300 | A | 9/1997 | Watanabe |
| 5,674,923 | A | 10/1997 | Subbaraman et al. |
| 5,681,620 | A | 10/1997 | Elgarhy |
| 5,698,303 | A | 12/1997 | Caldwell |
| 5,708,039 | A | 1/1998 | Daly et al. |
| 5,709,146 | A | 1/1998 | Watanabe |
| 5,718,170 | A | 2/1998 | Watanabe |
| 5,725,605 | A | 3/1998 | Maunz et al. |
| 5,734,396 | A | 3/1998 | Hale et al. |
| 5,760,122 | A | 6/1998 | Susa et al. |
| 5,763,016 | A | 6/1998 | Levenson et al. |
| 5,800,866 | A | 9/1998 | Myers et al. |
| 5,809,880 | A | 9/1998 | Okuda et al. |
| 5,820,638 | A | 10/1998 | Houser et al. |
| 5,824,362 | A | 10/1998 | Watanabe |
| 5,843,560 | A | 12/1998 | Ohta et al. |
| 5,851,595 | A | 12/1998 | Jones, Jr. |

5,852,072 A 12/1998 Banning et al.
5,869,172 A 2/1999 Caldwell
5,875,711 A 3/1999 Tateishi et al.
5,876,792 A 3/1999 Caldwell
5,879,746 A 3/1999 Tomihashi et al.
5,908,663 A 6/1999 Wang et al.
5,908,687 A 6/1999 Mori
5,919,858 A 7/1999 Loftin
5,922,088 A 7/1999 Cole et al.
5,924,359 A 7/1999 Watanabe
5,924,360 A 7/1999 Adachi et al.
5,924,361 A 7/1999 Watanabe
5,929,145 A 7/1999 Higgins et al.
5,948,534 A 9/1999 Altavilla
5,955,523 A 9/1999 Stephens et al.
5,958,137 A 9/1999 Caldwell et al.
5,958,547 A 9/1999 Fukunishi et al.
5,968,689 A 10/1999 Torikoshi et al.
5,981,021 A 11/1999 McCulloch
5,981,459 A 11/1999 Verbiest et al.
5,989,638 A 11/1999 Nielsen
5,992,315 A 11/1999 Lorenz
5,992,316 A 11/1999 Komata et al.
6,007,955 A 12/1999 Verhecken et al.
6,024,770 A 2/2000 De Lathauwer
6,025,066 A 2/2000 Terasawa et al.
6,032,576 A 3/2000 Collins
6,035,778 A 3/2000 Uchiyama
6,036,726 A 3/2000 Yang et al.
6,040,359 A 3/2000 Santini et al.
6,048,575 A 4/2000 Altavilla
6,050,183 A 4/2000 Tanaka et al.
6,063,476 A 5/2000 Kinoshita
6,069,221 A 5/2000 Chasser et al.
6,073,554 A 6/2000 Cutcher, Sr.
6,086,636 A 7/2000 Mheidle et al.
6,090,447 A 7/2000 Suzuki et al.
6,092,461 A 7/2000 Tanaka et al.
6,092,462 A 7/2000 Watanabe
6,099,995 A 8/2000 Altavilla
6,121,408 A 9/2000 Aoki et al.
6,136,046 A 10/2000 Fukunishi et al.
6,138,561 A 10/2000 Watanabe
6,147,041 A 11/2000 Takahashi et al.
6,194,106 B1 2/2001 Bretscher et al.
6,207,768 B1 3/2001 Sato et al.
6,209,453 B1 4/2001 Watanabe
6,211,308 B1 4/2001 Saint Victor
6,214,898 B1 4/2001 Barrio et al.
6,225,026 B1 5/2001 Lifshitz et al.
6,250,219 B1 6/2001 Garvin
6,251,987 B1 6/2001 Sacripante et al.
6,254,995 B1 7/2001 Kohno et al.
6,284,845 B1 9/2001 Panandiker et al.
6,294,222 B1 9/2001 Cohen et al.
6,294,610 B1 9/2001 Daly et al.
6,306,930 B1 10/2001 Tsujio
6,314,875 B1 11/2001 Steenbergen
6,341,856 B1 1/2002 Thompson et al.
6,348,679 B1 2/2002 Ryan et al.
6,348,939 B1 2/2002 Xu et al.
6,349,640 B1 2/2002 Takebe et al.
6,352,563 B1 3/2002 Kusaki et al.
6,357,347 B1 3/2002 Yoshida
6,358,461 B1 3/2002 Law et al.
6,376,589 B1 4/2002 Tanaka et al.
6,379,401 B1 4/2002 Legrand et al.
6,393,979 B1 5/2002 Tateishi
6,393,980 B2 5/2002 Simons
6,403,150 B1 6/2002 Ohta et al.
6,443,996 B1 9/2002 Mihelich et al.
6,446,551 B1 9/2002 Watanabe
6,447,895 B1 9/2002 Kamir et al.
6,458,192 B1 10/2002 Tsujio
6,488,719 B2 12/2002 Lomasney et al.
6,497,936 B1 12/2002 Desai et al.
6,506,221 B1 1/2003 Macholdt et al.
6,506,445 B2 1/2003 Popat et al.
6,509,555 B1 1/2003 Riess et al.
6,532,867 B2 3/2003 Nakamura et al.
6,533,824 B1 3/2003 Roper
6,536,338 B2 3/2003 Nakamura et al.
6,539,856 B2 4/2003 Jones et al.
6,550,380 B2 4/2003 Kinoshita et al.
6,572,951 B2 6/2003 Hasegawa et al.
6,584,897 B2 7/2003 Cobbley et al.
6,585,369 B1 7/2003 Sievert et al.
6,593,401 B1 7/2003 Park et al.
6,595,129 B2 7/2003 Mori
6,600,142 B2 7/2003 Ryan et al.
6,602,566 B2 8/2003 Steenbergen
6,618,066 B2 9/2003 Hale et al.
6,623,576 B2 9/2003 Mitchell et al.
6,645,569 B2 11/2003 Cramer et al.
6,649,317 B2 11/2003 Wagner et al.
6,649,888 B2 11/2003 Ryan et al.
6,653,265 B2 11/2003 Rossi et al.
6,655,271 B1 12/2003 Contompasis
6,659,003 B2 12/2003 Nakamura et al.
6,662,719 B1 12/2003 Adachi et al.
6,673,503 B2 1/2004 Wagner et al.
6,675,705 B2 1/2004 Yamamoto et al.
6,679,166 B2 1/2004 Nakamura et al.
6,681,691 B2 1/2004 Foster et al.
6,686,314 B2 2/2004 Xu et al.
6,703,089 B2 3/2004 DeProspero et al.
6,719,467 B2 4/2004 Hess et al.
6,723,413 B2 4/2004 Walters
6,723,428 B1 4/2004 Foss et al.
6,743,848 B2 6/2004 Nakahara et al.
6,758,138 B2 7/2004 Nakamura et al.
6,766,736 B2 7/2004 Regner et al.
6,779,443 B2 8/2004 Martinez et al.
6,790,819 B2 9/2004 Trinh et al.
6,794,007 B2 9/2004 Carr et al.
6,807,904 B2 10/2004 Ohshima et al.
6,815,005 B2 11/2004 Stevenson et al.
6,820,546 B2 11/2004 Wynne
6,841,233 B2 1/2005 Kinoshita et al.
6,841,244 B2 1/2005 Foss et al.
6,844,392 B2 1/2005 Suman
6,849,370 B2 2/2005 Wagner et al.
6,863,933 B2 3/2005 Cramer et al.
6,866,924 B2 3/2005 Yamaguchi
6,872,443 B2 3/2005 Franke
6,872,444 B2 3/2005 McDonald et al.
6,887,640 B2 5/2005 Zhang et al.
6,887,916 B2 5/2005 Zhou et al.
6,889,605 B1 5/2005 Natori et al.
6,890,974 B2 5/2005 Park et al.
6,893,662 B2 5/2005 Dittmar et al.
6,894,090 B2 5/2005 Shinzo et al.
6,916,774 B2 7/2005 Trinh et al.
6,927,253 B2 8/2005 Lassmann et al.
6,936,075 B2 8/2005 Vogt et al.
6,946,049 B2 9/2005 Yamaguchi
6,946,149 B2 9/2005 Cleveland
6,951,670 B2 10/2005 Stroppiana
6,968,780 B2 11/2005 Birch
6,977,098 B2 12/2005 Gurer et al.
6,977,111 B2 12/2005 Yamaguchi et al.
6,982,108 B2 1/2006 Janssen et al.
6,992,028 B2 1/2006 Thomaschefsky et al.
7,008,889 B2 3/2006 Black et al.
7,018,429 B1 3/2006 Wenstrup
7,022,377 B2 4/2006 Kanada et al.
7,041,424 B2 5/2006 Xu et al.
7,066,993 B2 6/2006 Wuzik et al.
7,105,597 B2 9/2006 Soda et al.
7,108,728 B2 9/2006 Sunamori et al.
7,112,621 B2 9/2006 Rohrbaugh et al.
7,134,390 B2 11/2006 Cobbley et al.
7,156,017 B1 1/2007 Ingraselino
7,186,450 B2 3/2007 Foxon
7,223,477 B2 5/2007 Muthiah
7,226,607 B2 6/2007 Uchiyama et al.
7,264,861 B2 9/2007 Zafiroglu et al.
7,279,212 B2 10/2007 Foxon

| | | | |
|---|---|---|---|
| 7,288,288 | B2 | 10/2007 | Milic et al. |
| 7,288,585 | B2 | 10/2007 | Moad et al. |
| 7,316,832 | B2 | 1/2008 | Steinhardt et al. |
| 7,348,374 | B2 | 3/2008 | Martinazzo |
| 7,374,808 | B2 | 5/2008 | Sellman, Jr. et al. |
| 7,622,154 | B2 | 11/2009 | Eriksson et al. |
| 7,622,175 | B2 | 11/2009 | Pallotta et al. |
| 2001/0053415 | A1 | 12/2001 | Jiang et al. |
| 2002/0011159 | A1 | 1/2002 | Mazaki |
| 2002/0020310 | A1 | 2/2002 | Tanaka et al. |
| 2002/0040503 | A1 | 4/2002 | Pace et al. |
| 2002/0077261 | A1 | 6/2002 | Hwang et al. |
| 2002/0139257 | A1 | 10/2002 | Cobbley et al. |
| 2002/0166468 | A1 | 11/2002 | Schmid et al. |
| 2003/0070569 | A1 | 4/2003 | Bulthaup et al. |
| 2003/0075059 | A1 | 4/2003 | Mori et al. |
| 2003/0092589 | A1 | 5/2003 | Todini et al. |
| 2003/0110962 | A1 | 6/2003 | Kinoshita et al. |
| 2003/0134114 | A1 | 7/2003 | Pallotta et al. |
| 2003/0150340 | A1 | 8/2003 | Yamamoto et al. |
| 2003/0157377 | A1 | 8/2003 | Muthiah |
| 2003/0194560 | A1 | 10/2003 | Spera et al. |
| 2004/0035307 | A1 | 2/2004 | Ohshima et al. |
| 2004/0035308 | A1 | 2/2004 | Nakamura |
| 2004/0040454 | A1 | 3/2004 | Pearson et al. |
| 2004/0110865 | A1 | 6/2004 | McCovick et al. |
| 2004/0110867 | A1 | 6/2004 | McCovick |
| 2004/0118305 | A1 | 6/2004 | Martinez et al. |
| 2004/0154106 | A1 | 8/2004 | Oles et al. |
| 2004/0177452 | A1 | 9/2004 | Donaldson et al. |
| 2004/0200564 | A1 | 10/2004 | Kinsey et al. |
| 2004/0230008 | A1 | 11/2004 | Correll et al. |
| 2004/0237814 | A1 | 12/2004 | Caplan |
| 2005/0089703 | A1 | 4/2005 | Tamaguchi |
| 2005/0090627 | A1 | 4/2005 | Wenning et al. |
| 2005/0095933 | A1 | 5/2005 | Kimbrell et al. |
| 2005/0155693 | A1 | 7/2005 | Zafiroglu |
| 2005/0183207 | A1 | 8/2005 | Chan et al. |
| 2005/0199152 | A1 | 9/2005 | Hale et al. |
| 2006/0009591 | A1 | 1/2006 | Wu |
| 2006/0051571 | A1 | 3/2006 | Steinhardt et al. |
| 2006/0134384 | A1 | 6/2006 | Vinson et al. |
| 2006/0135668 | A1 | 6/2006 | Hayes |
| 2006/0165979 | A1 | 7/2006 | Kinsey et al. |
| 2006/0165989 | A1 | 7/2006 | Takikawa et al. |
| 2007/0014921 | A1 | 1/2007 | Kimball et al. |
| 2007/0036969 | A1 | 2/2007 | Magnin et al. |
| 2007/0037902 | A1 | 2/2007 | McCovick |
| 2007/0082171 | A1 | 4/2007 | Fulton |
| 2007/0089621 | A1 | 4/2007 | Kimball et al. |
| 2007/0141247 | A1 | 6/2007 | Hall et al. |
| 2007/0232179 | A1 | 10/2007 | Polat et al. |
| 2007/0270064 | A1 | 11/2007 | Aseere |
| 2007/0275207 | A1 | 11/2007 | Higgins et al. |
| 2007/0286982 | A1 | 12/2007 | Higgins et al. |
| 2008/0064802 | A1 | 3/2008 | Abecassis et al. |
| 2008/0131647 | A1 | 6/2008 | Shimizu et al. |
| 2008/0280059 | A1 | 11/2008 | Adams et al. |
| 2009/0022957 | A1 | 1/2009 | Aso et al. |
| 2010/0028586 | A1 | 2/2010 | Enlow et al. |

FOREIGN PATENT DOCUMENTS

| | | | |
|---|---|---|---|
| DE | 102 24 984 | | 12/2003 |
| EP | 0 103 407 | | 8/1986 |
| EP | 0 103 344 | | 10/1988 |
| EP | 0 307 624 | | 3/1989 |
| EP | 0 569 921 | | 11/1993 |
| EP | 0 752 498 | | 1/1997 |
| EP | 0 803 351 | | 10/1997 |
| EP | 0 993 876 | | 4/2000 |
| EP | 1 132 439 | | 9/2001 |
| EP | 1 283 296 | | 2/2003 |
| GB | 531 766 | | 1/1941 |
| GB | 669 739 | | 4/1952 |
| GB | 721 827 | | 1/1955 |
| GB | 774 078 | | 5/1957 |
| GB | 1 366 343 | | 9/1974 |
| GB | 1 461 049 | | 1/1977 |
| GB | 2 152 841 | A | 8/1985 |
| JP | 01 111081 | | 4/1989 |
| JP | 2002142956 | | 5/2002 |
| WO | WO 98/08915 | | 3/1998 |
| WO | WO 2004/066793 | | 1/2004 |
| WO | 2010018094 | A2 | 2/2010 |
| WO | 2010018096 | A1 | 2/2010 |

OTHER PUBLICATIONS

Rohm and Haas. MSDS Acrylic Binder for Textile and Nonwoven applications.

www.coloryourcarpet.com, Home Page (3 pages).

U.S. Appl. No. 11/447,787, Office Action dated Dec. 28, 2006.

Intl. Search Report and Written Opinion dated Oct. 23, 2006, Appl. No. PCT/US 2006/021885.

Intl. Search Report and Written Opinion dated Feb. 28, 2007, Appl. No. PCT/US 2006/021884.

Intl. Search Report and Written Opinion dated Jul. 20, 2007, PCT/US2006/021848.

U.S. Appl. No. 11/447,787, Office Action dated Feb. 14, 2008.

U.S. Appl. No. 11/447,787, Office Action dated Dec. 13, 2007.

U.S. Appl. No. 11/447,694, Office Action dated Sep. 5, 2008.

United States Patent and Trademark Office, Office Action Summary and Detailed Action, U.S. Appl. No. 11/447,439, Apr. 16, 2009.

United States Patent and Trademark Office, Office Action Summary and Detailed Action, U.S. Appl. No. 11/447,439, Sep. 16, 2009.

United States Patent and Trademark Office, Office Action Summary and Detailed Action, U.S. Appl. No. 11/447,439, Mar. 1, 2010.

United States Patent and Trademark Office, Notice of Allowability and Detailed Action, U.S. Appl. No. 11/447,439, Mar. 17, 2010.

United States Patent and Trademark Office, Supplemental Notice of Allowability and Supplemental Examiners Amendment, U.S. Appl. No. 11/447,439, Apr. 29, 2010.

United States Patent and Trademark Office, Office Action Summary and Detailed Action, U.S. Appl. No. 11/447,694, May 28, 2008.

United States Patent and Trademark Office, Office Action Summary and Detailed Action, U.S. Appl. No. 11/447,694, Apr. 9, 2009.

United States Patent and Trademark Office, Office Action Summary and Detailed Action, U.S. Appl. No. 11/447,694, Jul. 8, 2009.

United States Patent and Trademark Office, Office Action Summary and Detailed Action, U.S. Appl. No. 11/447,694, Nov. 3, 2009.

United States Patent and Trademark Office, Before the Board of Patent Appeals and Interferences, Examiners Answer, U.S. Appl. No. 11/447,694, Jun. 9, 2010.

MULTILAYER STENCILS FOR APPLYING A DESIGN TO A SURFACE

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

Enhancement of surfaces that may be permanently or temporarily re-designed, decorated, and/or re-colored with a design device is disclosed herein.

2. Description of the Background of the Invention

Improving the aesthetics in homes has long been practiced by many consumers. There is a plethora of home products and techniques for cleaning surface areas of soft surfaces such as carpets, rugs, draperies, curtains, upholstery, and the like. However, for more sullied and/or worn surfaces, subtractive processes (for example, a process that chemically or physically removes something from the carpet, such as cleaning or shaving) cannot truly restore the surface to its original state; this is often very frustrating for consumers. Oftentimes, spots and stains reappear after treatment.

Additive processes (for example, a process that layers, covers, or masks something undesirable underneath) and techniques for improving the aesthetics of surfaces include painting, faux painting, stenciling, bordering, wallpapering, tiling, wainscoting, paneling, decorative plastering, adding appliqués (for example, pictures, cut-outs, stickers, or the like), laminating, and molding (for example, crown, shoe, and chair) are also known. However, these products and techniques have not been applied to soft surfaces such as carpets, rugs, draperies, curtains, upholstery, and the like.

SUMMARY OF THE INVENTION

According to one aspect of the present disclosure, a stencil for use in applying a design to a desired surface includes a first layer having an embossed top surface and a bottom surface, the first layer including an absorptive non-woven base. The non-woven base includes a blend of natural and/or synthetic material. The stencil also includes a second layer having a top surface and a bottom surface, the top surface of the second layer attached to the bottom surface of the first layer. In addition, the stencil includes a third layer including a structured material and having a top surface attached to the bottom surface of the second layer and a bottom surface. The stencil further includes a fourth layer having a top surface attached to the bottom surface of the third layer and a bottom surface of the fourth layer having an average static coefficient of friction of about 0.3 to about 0.8 and an average kinetic coefficient of friction of about 0.2 to about 0.8 as measured against a bottom surface having the same bottom surface as the bottom surface as the fourth layer. One or more cutout portions in the stencil extend through the first through fourth layers that allow passage of a material therethrough to apply the design to the desired surface.

In another aspect of the present disclosure, a stencil for applying a design to a desired surface includes a first layer having an embossed top surface and a bottom surface. The first layer includes an absorptive non-woven base that comprises a blend of a natural material and/or a synthetic material. The stencil also includes a second layer that includes a liquid impervious top layer and a bottom low-slip layer. The top layer of the second layer includes a cellulosic material. The bottom low-slip layer includes polyethylene and has a static coefficient of friction that is between about 0.2 to about 1.2 and a kinetic coefficient of friction that is between about 0.1 and 1.1 as measured against the bottom surface of another surface having the same bottom surface as the fourth layer. One or more cutout portion of the stencil extends through the first through the third layers and allows passage of a composition therethrough to apply the design to the desired surface.

In still another aspect of the present disclosure, a kit for applying a design to a desired surface includes a low-slip stencil having a bottom surface that has an average static coefficient of friction of about 0.3 to about 0.8 and an average kinetic coefficient of friction of about 0.2 to about 0.8 as measured against a bottom surface of another surface having the same bottom surface as the fourth layer, wherein the bottom surface inhibits lateral movement of the stencil against the desired surface. The kit also includes a container including a composition that comprises about 0.1% to about 10% by weight substantially homogenous particles comprising a catalyst and a resin, the resin comprising at least on of an acrylic, acrylic latex, a polyester, a urethane, or an epoxy, and emulsifier, and a liquid carrier.

DETAILED DESCRIPTION OF THE PREFERRED EMBODIMENTS

Figure 1:
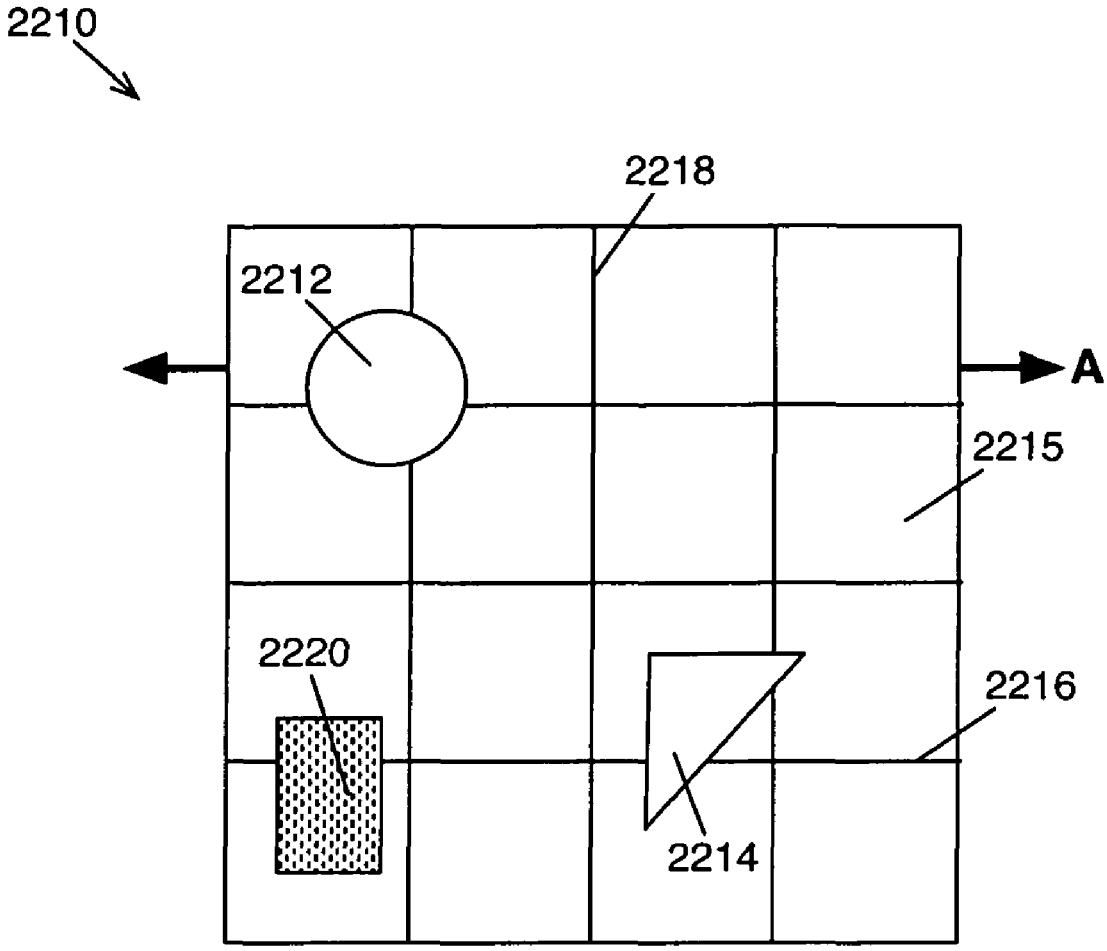
FIG. 1 is an illustration of a plan view of a design device according to one embodiment.

The present disclosure is directed to compositions, methods, apparatuses, kits, and combinations, for permanently or temporarily re-designing, decorating, and/or re-coloring a surface. While several specific embodiments are discussed herein, it is understood that the present disclosure is to be considered only as an exemplification of the principles of the invention, and it is not intended to limit the disclosure to the embodiments illustrated.

For example, a composition useful in the present disclosure includes a décor product that is formulated to be applied and affixed to a surface. The décor product may also be utilized in the form of a kit or in conjunction with a design device, such as a stencil, to control the application of the décor product to create, for example, a pattern on the surface.

Any surface is contemplated to which the décor product may be applied and/or affixed, including, for example, soft surfaces such as carpets, rugs, draperies, curtains, upholstery, and the like. In addition, the décor product may be applied to hard surfaces as well, including, for example, wood, metal, ceramic, glass, a polymer, a hard floor tile, a painted surface, paper, masonry material, rock, a fiber/composite material, rubber, concrete, and the like. It is contemplated that the décor product may be applied to any prepared surface, including, for example, pre-dyed, post-dyed, pre-manufactured, and post-manufactured surfaces. Further, the décor product may be applied during the manufacturing process of a particular good or object that includes a surface in which the décor product may be applied. Surfaces to which the décor product may be applied and/or affixed may be substantially dry, substantially wet, moist, or humid depending on the particular décor product utilized. Further, a décor product of the present disclosure may be applied to a substantially flat, smooth, and/or level surface or any other surface including rough, bumpy, non-smooth, stepped, sloped, slanted, inclined, declined, and/or disturbed surfaces.

Examples of carpets to which the décor product may be applied and/or affixed include modular tiles and panels such as Milliken LEGATO®, Milliken TESSERAE®, INTERFACEFLOR™, Tandus/C&A floorcovering, and from manufacturers such as Mohawk Industries and Shaw Industries, Inc. Additional examples of carpets include broadloom carpets, cut pile (velvet/plush, Saxony, frieze, shag), loop pile (level loop, multi-level loop, and Berber), and cut and loop pile (random sheared and tip sheared) carpets. Additional examples of soft surfaces to which a décor product may be applied and/or affixed thereto include, for example, area rugs (hand woven or machine woven), draperies, curtains, upholstery, and cellulosic materials, among others. Constituent materials of candidate soft surfaces include, for example, natural fibers such as wool and cotton, or synthetic fibers such as nylon 6, nylon 6-6, polyester, polypropylene (olefin), and acrylic, among others.

Decor products of the present disclosure may be formulated, designed, produced, manufactured, applied, removed, and/or packaged by any formulaic, chemical, and/or physical preparation appropriate for the specific embodiment desired, as would only be limited by the inherent nature of the constituent ingredients. Illustrative formulations of the décor products include a solid that may be dissolved or dispersed in a liquid to make a liquid-based décor product, a liquid carrier, an emulsion, a suspension, a colloid, a sol, a dispersion, a solution, a gel, a paste, a foam, a powder, a spray, a tablet, a solid, a gas, a diluent such as water or other solvent, an aerosol, and combinations thereof. Examples of chemical preparations include polyester polymerizations, latex aggregation, chemical milling, and microencapsulization, and other methods known to those skilled in the art. Physical preparation may consist of physically grinding the décor product ingredients or other means known to those skilled in the art. Décor products may be either synthesized from a molecular route, in which polymer resin molecules incorporate colorants, dyes, and/or pigment particles at the molecular scale, such as in the method of manufacture used in chemically prepared toners, or the resin and pigment particles may be physically blended together and crushed to appropriate size by mechanical means known to those skilled in the art.

Examples of applicators and/or dispensers of the décor product of the present disclosure include, for example, an intermittent pressurized sprayer (such as PULL 'N SPRAY® liquid applicator marketed by The Scotts and Miracle-Gro Company), an actuator spray bottle, a trigger sprayer, a mechanical spray bottle, a pump and/or pump system, a liquid refill containing the décor product for a pressurized air chamber, an aerosol barrier pack containing the décor product with a driving chamber (with a propellant, for example, carbon dioxide or a hydrocarbon), and a liquid or gel chamber for containing the décor product where use would allow pressurized spraying with reduced propellant release to the atmosphere or room being decorated by the user. Other useful sprayers include those disclosed in, for example, U.S. Pat. No. 6,872,444. Yet other dispensers useful in the present invention include those disclosed in, for example, U.S. patent application Ser. No. 12/152,311, filed on May 14, 2008, filed on the same day as the present application.

A stencil may be used to assist in the application of the décor product to a surface for the purpose of creating, for example, a pattern on the surface to enhance the aesthetic effect of the décor product. Possible décor product patterns on surfaces contemplated in the present disclosure include any and all images, patterns, shapes, and/or designs. Preselected or random patterns may also be imparted to a surface using an inherent dispersal pattern from a décor product applicator with or without movement of the applicator over a selected surface during application of the décor product. For example, by using a spray applicator with a cone-shaped dispersal pattern, a user may choose to apply discrete spots and/or circles having diameters that are varied by varying the distance from which the applicator is held from the surface during application of the décor product. Further, a user may move the applicator during application of the décor product over the surface in a predetermined or random pattern to achieve a predetermined or random pattern on the surface. As such, preselected patterns and/or random patterns may be imparted to a surface with or without a design device.

Stencils or other design devices contemplated for use in the present disclosure may be designed, constructed, shaped, and/or reshaped, in a predetermined, ordered, disorganized, and/or random manner by means of laser, knife, die cutting, and/or any other appropriate means as determined by the nature of the stencil material (for example, hardness or softness of the stencil materials) to render a predetermined, ordered, disorganized, and/or random shape that allows a predetermined, ordered, disorganized, and/or random deposition of at least a visual design by introducing a décor product on a surface. The stencils may further be laminated and have additional layers applied thereto post-construction and/or post-designing.

The present disclosure also provides kits that contain one or more components herein described, including, for example, a design device and/or a décor product that may be substantially removed from a surface prior to being affixed thereon. A set of instructions may also be included in the kit instructing the user how to apply the design to a soft surface such as a carpet. The kit may further comprise one or more application devices for transferring the décor product to the carpet and/or one or more fixative devices for affixing the décor product to the surface. In addition, the kit may include a protective covering for protecting the décor product after it has been applied to the carpet, especially while it is drying. The kit may further include an iron screen that is used to provide a user with an indication of what areas of the décor product have already been ironed or affixed.

As an example, the kit may be provided having one or more stencils, for example, five stencils, a décor product, an application device such as a sprayer, an affixing device such as a heating device (for example, an iron or a radio frequency emitting device), and/or a set of instructions. The kit may also include a system to identify, choose, make, modify, and/or prepare the surface on which the décor product is to be applied.

FIG. 1 shows an embodiment of a stencil 2210 that has cutouts 2212 an 2214. The surface 2215 of the stencil 2210 may have markings printed thereon. For example, the stencil 2210 may have printed thereon horizontal and vertical gridlines, 2216 and 2218, respectively, which can be used, for example, to align the stencil 2210 with other stencils and/or with patterns are other markings on a surface and/or a wall, for example. In addition, the stencil 2210 may have printed thereon instructions 2220 that provide the user with information on how to use and/or care for the stencil. Other types of markings such as patent numbers, marketing information, logos, and the like may also be printed on the surface 2215 of the stencil 2210.

Figure 2A:
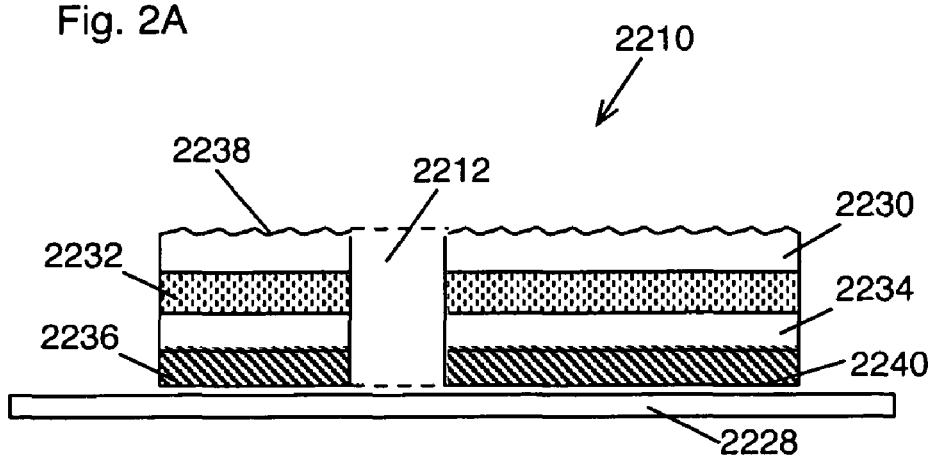
FIG. 2A-C are a cross-sectional views of embodiments of the design device illustrated in FIG. 1.

A cross-section along the line A of an embodiment of the stencil 2210 is shown in FIG. 2A to illustrate the one arrangement of layers that may comprise the stencil 2210. Illustratively, the stencil 2210 may include an absorptive layer 2230, an attachment and barrier layer 2232, a structured layer 2234, and a low-slip flatness coating layer 2236.

When the stencil 2210 is placed on a surface 2228 (for example, a floor and/or a wall), the various layers that comprise the stencil 2210 may be configured to inhibit and/or prevent excess décor product that is applied to the stencil 2210 but does not pass through the cutouts from reaching the surface 2228. The absorptive layer 2230 acts as a material containment layer that absorbs the excess décor product. For example, one embodiment of the stencil 2210 comprises an absorptive layer 2230 that is able to absorb an amount of liquid equal to several times the weight thereof, such as between about eight to about eleven times the weight of the absorptive layer 2230. The absorptive layer 2230 may be manufactured from, for example, a combination of woven and non-woven, natural and synthetic materials including pulp, paper, synthetic fibers, cotton, cotton fabrics, rayon, polyester, lycocell, lyocel, polypropylene, etc. The absorptive layer 2230 in some embodiments of the stencil 2210 may comprise, by weight, from about 50% to about 90% rayon, from about 60% to about 80% rayon, from about 50% rayon, from about 60% rayon, about 70% rayon, about 80% rayon, or about 90% rayon. Some embodiments of the stencil 2210 comprise an absorptive layer 2230 that may comprise from about 10% to about 50% polyester, from 20% to about 40% polyester, about 10% polyester, about 20% polyester, about 30% polyester, about 40% polyester, or about 50% polyester. In some embodiments of the absorptive layer 2230 may comprise a blend that has a greater portion, by weight, of polyester than rayon. Other embodiments of the absorptive layer 2230 may include a blend having about equal portions, by weight, of rayon and polyester. Illustratively, the absorptive layer 2230 comprises about 70% rayon and about 30% polyester by weight, or about 60% rayon and about 40% polyester by weight, or about 50% rayon and about 50% polyester by weight, or about 40% rayon and about 60% polyester by weight. In another embodiment, the absorptive layer 2230 comprises a spunbond textured (for example, having a 3 mm dot pattern) blend of about 70% rayon (for example, lyocel, manufactured by Lenzing Inc, under the trademark Tencel®, or other cellulose fabric that is obtained by an organic solvent spinning process) and about 30% polyester by weight. Other components, for example, anti-static materials, may also be incorporated as desired into the absorptive layer 2230 in addition to the woven and/or non-woven materials.

The top surface 2238 of the absorptive layer 2230 may be embossed to reduce overspray that may be generated when a liquid is sprayed thereon. The top surface 2238 may be embossed using a process compatible with the materials that includes the absorptive layer 2230 including, for example, hydro-embossing, heat embossing, and/or mechanical embossing (for example, stamping).

In this embodiment, the attachment and barrier layer 2232 enables attachment of the absorptive layer 2230 to the structured layer 2234. The attachment and barrier layer 2232 may be an adhesive material that bonds the absorptive layer 2230 to the structured layer 2234. Alternately or in addition to, the attachment and barrier layer 2232 may include a moisture resistant adhesive and/or a moisture resistant polymer such as polyethylene. In such cases, the attachment and barrier layer 2232 may both bond the absorptive layer 2230 to the structured layer 2234 and/or provide a liquid impermeable layer by providing a barrier that prevents or inhibits liquids absorbed by the absorptive layer 2230 from being released to the structured layer 2234.

A material that combines together the absorptive layer 2230 and the attachment and barrier layer 2232 may also be used. An example of such a material includes the commercially available GOTCHA COVERED® drop cloth by Kimberly-Clark Corp.

If desired, the structured layer 2234 may provide rigidity to the stencil 2210. The structured layer 2234 may also form a moisture barrier that blocks or retards the release of liquids absorbed by the absorptive layer 2230 to the surface 2228. The structured layer 2234 may be comprised of a cellulosic material such as cardboard or paper, polymer based films such as Mylar®, a polymer based foam, a foil film, semi-stiff nonwoven (for example, needle punched) materials, polycoated nonwoven materials, corrugated board, and combinations thereof. In some embodiments, paperboard between about 12-point to about 22-point may comprise the structured layer 2234. For example, 18-point paperboard may be sufficiently rigid for use as a material for the structured layer 2234. For certain applications, described below, the material selected for the structured layer 2234 may allow the stencil 2210 to be folded or to be cut into a desired shape using common tools such as a utility knife or scissors.

In yet other embodiments, the low-slip and flatness coating layer 2236 allows the stencil 2210 to lay flat and remain static on the surface 2228 but has sufficient slip to allow the stencil 2210 to be repositioned by a user by sliding across the surface 2228 as necessary. For example, the low-slip and flatness coating layer 2236 has coefficient of friction properties that prevent or inhibit lateral movement of the stencil 2210 against the surface 2228 sufficient for a user to apply the stencil to the surface and readjust the location thereof as needed, but also to allow the application of the décor product thereto without the stencil moving inappropriately before, during, and/or after the application of the décor product to the surface. Illustratively, the low-slip and flatness coating layer 2236 is a coating that is applied to the bottom surface of the structured layer 2234. The coating may comprise, for example, a wax, a polymer (for example, polyethylene), a thermoplastic, silicone, and/or polytetrafluoroethylene. Further examples of coatings useful in the present disclosure include water-based coatings, water-based emulsions and dispersions, solvent-borne dispersions, and micronized powders for paper, film and foil packaging, such as those available from Michelman, Inc., Cincinnati, Ohio, including, for example, Michem® Prime, a ethylene-acrylic acid co-polymer dispersion, MillWhite™, a non-waxable white coating, SofTak®, a water-based coating to increase skid angle, and Wax Dispersion 40®, a solvent dispersion of paraffin wax. Combinations of the above coating may also be used to achieve the desired slip resistance or static or kinetic coefficient of friction properties.

In one embodiment, the low-slip and flatness coating layer 2236 may comprise a low-tack adhesive that is applied to the bottom surface of the structured layer 2234. In some embodiments, the low-slip and flatness coating layer 2236 may also be liquid impermeable and provide a barrier that prevents or inhibits liquids absorbed by the absorptive layer 2230 from being released to the surface 2228 on which the stencil is placed. For example, by including a moisture resistant material in the low-slip and flatness coating layer 2236.

In one embodiment, a stencil 2210 includes a structured layer 2234 of 16-18 point paperboard and a low-slip and flatness coating layer 2236 formed by coating the structured layer 2234 with about 7 to about 10 pounds per 100 square feet of mirror finished polyethylene. In other embodiments, a low density polyethylene may be used. In still other embodiments, a coated paperboard may be used whereby the paperboard may supply the structured layer 2234 and the coating may supply the low-slip and flatness coating layer 2236. Examples of such coated paperboard products include polyethylene extrusion or wax coated CartonMate® bleached boards or coated recycled boards (for example, Angelcote®) manufactured by Rock-Tenn Company, Norcross, Ga.

Illustratively, the bottom surfaces 2240 of a plurality of such stencils (for example, the bottom surfaces of the low-slip and flatness coating layers 2236) may have static coefficients of friction that range from about 0.4 to about 0.7 and kinetic coefficients of friction that range from about 0.3 to about 0.5 when measured relative to a bottom surface of another stencil in the manufacturing (grain) direction of the paperboard. The bottom surface 2240 of some embodiments of the stencil 2210 may have a static coefficient of friction from about 0.3 to about 0.8 and a kinetic coefficient of friction from about 0.2 to about 0.6. Static and kinetic coefficient of friction may be determined using methods known in the art including, for example, standardized method such as the ASTM D-2047 or using a frictionometer as known by those skilled in the art.

When measured relative to the bottom surface of another stencil having the same or identical bottom surface in the cross direction of the paperboard, the bottom surface 2240 of an embodiment of the stencil 2210 may have a static coefficient of friction that ranges from about 0.4 to about 1.0, from about 0.3 to about 1.1, or from about 0.2 to about 1.2. Some embodiments of the stencil 2210 may have a bottom surface 2240 that has a kinetic coefficient of friction that ranges from about 0.3 to about 0.9, from about 0.2 to about 1.0, or from about 0.1 to about 1.1.

Some embodiments of the stencil 2210 may have a bottom surface 2240 with an average static coefficient of friction that range from about 0.3 to about 0.8, from about 0.4 to about 0.7, or from about 0.5 to about 0.6. The average kinetic coefficients of friction of the bottom surface 2240 of some embodiments of the stencil 2210 may range from about 0.4 to about 0.6, from about 0.3 to about 0.7, or from 0.2 to about 0.8.

Figure 2B:
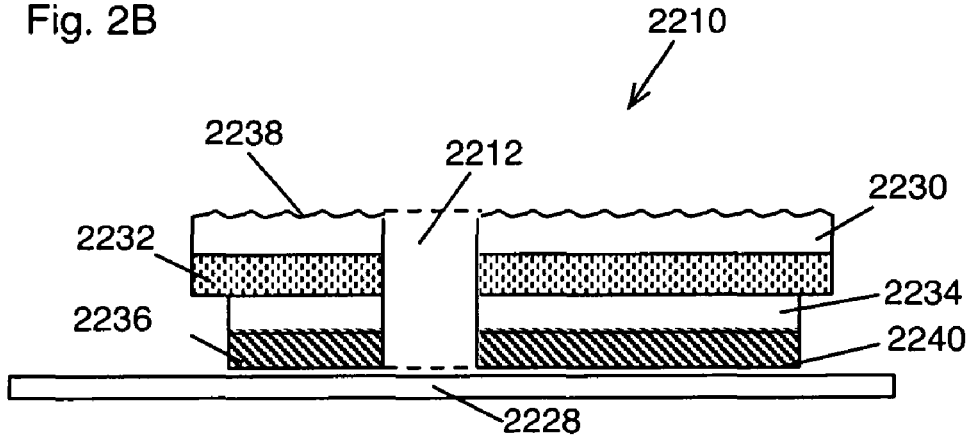

In some embodiments, the layers that comprise the stencil 2210 have substantially identical planar dimensions. In other embodiments, adjusting the sizes of the individual layers that comprise the stencil may retain properties of the stencil (for example, absorbency and rigidity) while optimizing other aspects (for example, material cost) of the stencil. For example, FIG. 2B illustrates a cross-section along the line A of another embodiment of the stencil 2210. Such embodiment is similar to the one depicted in FIG. 2A, however, the structured layer 2234 and the low-slip and flatness coating layer 2236 of the stencil are smaller than the absorptive layer 2230 and the attachment and barrier layer 2232. It should be apparent that the material cost of the stencil shown in FIG. 2B may be less than the material cost of the stencil shown in FIG. 2A.

It should be apparent that the layers that comprise the stencil 2210 do not have to have identical thickness. For example, the absorptive layer 2230 may be thicker than the structured layer 2234, and each of these may be thicker than either the attachment and barrier layer 2232 or the low-slip and flatness coating layer 2236. The thickness of the individual layers and the stencil 2210 as a whole may be optimized according to the environment and application in which the stencil 2210 may be used and/or to the specific composition that is being applied with the stencil 2210 and the liquid content thereof. For example, in some applications, the thickness of the stencil 2210 may be minimized to reduce bulk while maintaining the absorptive properties and structural integrity thereof. In other applications, the thickness of the stencil 2210 may not matter and production cost may be optimized. In some embodiments, the thickness of the structured layer 2234 may be from about 0.011 inches to 0.025 inches thick, from about 0.013 to about 0.023 inches thick, from about 0.015 to about 0.021 inches thick, from about 0.013 to about 0.015 inches thick, about 0.014 inches thick, about 0.016 inches thick, about 0.018 inches thick, about 0.020 inches thick, or about 0.22 inches thick. In some embodiments, the thickness of the attachment and barrier layer 2232 and/or the low-slip and flatness coating layer 2236 may be from about 0.0002 inches to 0.0008 inches thick, from about 0.0004 inches to about 0.0006 inches thick, about 0.0003 inches thick, about 0.0005 inches thick, or about 0.0007 inches thick.

It is contemplated that any of the layers that comprise the stencil 2210 may be liquid impermeable and prevent or reduce passage of liquid deposited onto the surface of the stencil 2238 from migrating to the surface 2228 onto which the stencil is placed. It is further contemplated that any of the layers that comprise the stencil 2210 may provide structure to the stencil. In addition, any of the layers of the stencil 2210 may have absorptive properties and may provide containment of materials deposited onto the surface of the stencil 2238.

Similarly, the portion of the weight that the individual layers of a stencil 2210 comprise may not be identical. For example, in one embodiment of the stencil 2210, the absorptive layer 2230 comprised approximately 25% of the weight of the stencil 2210 and the structured layer 2234 comprised approximately 75% of the weight of the stencil 2210. In some embodiments, the attachment and barrier layer 2232 and/or low-slip and flatness coating layer 2236 may comprise from about 0.5% to about 1.5% of the total weight of the stencil 2210 or, in other embodiments, may comprise less than about 1% of the total weight of the stencil 2210.

Figure 2C:
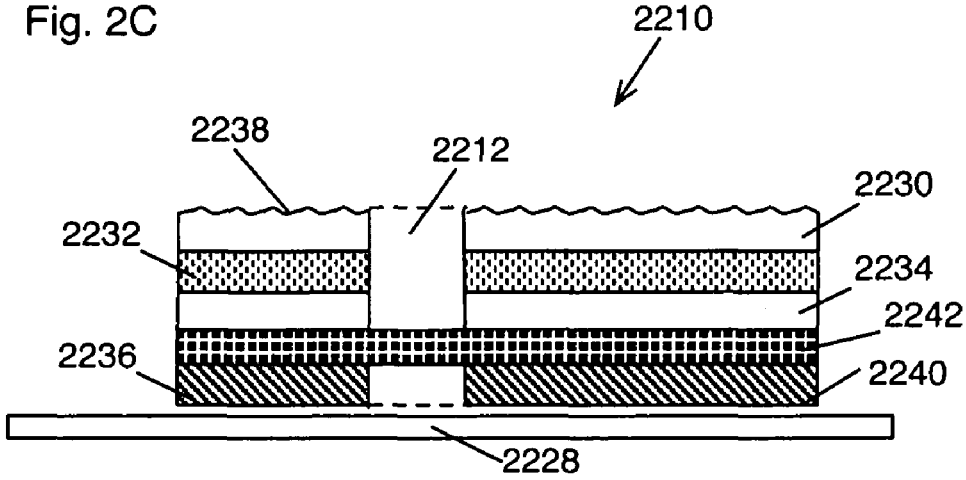

Additional layers may be incorporated into the stencil 2210. For example, FIG. 2C shows a cross section of an embodiment of the stencil 2210 that has an absorptive layer 2230, an attachment and barrier layer 2232, a structured layer 2234, and a low-slip and flatness coating layer 2236 identical to those of the embodiment of the stencil 2210 illustrated in FIG. 2A. The embodiment of the stencil 2210 shown in FIG. 1 includes an additional support layer 2242 which may be comprised of threads, a mesh, or a scrim to assist in supporting the edges of the cutout portions 2212 and 2214 of the stencil. In some embodiments, the additional support layer may be deposited between the absorptive layer 2230 and the attachment and barrier 2232 layer. In still other embodiments, the additional support layer 2242 may be situated between the attachment and barrier layer 2232 and structured layer 2234.

The additional support layer 2242 may also be positioned on the top surface 2238 of the absorptive layer 2230. For example, an additional layer 2242 comprising threads may be attached to the top surface 2238 of the stencil 2210. The additional support layer 2242 may be attached either during the manufacture of the stencil 2210 and/or as an additional post processing step. Similarly, the additional support layer 2242 may be added to the bottom surface 2240 of the stencil 2210.

Two or more additional support layers 2242 may also be used. For example, a first additional support layer 2242 may be situated between the absorptive layer 2230 and the attachment and barrier 2232 layer and a second additional support layer 2242 may be situated between the structured layer 2234 and the low-slip and flatness coating layer 2236. In such embodiments, the first and second additional support layers 2242 may be identical or different. For example, the first additional support layer 2242 may be comprised of threads and the second additional support layer may comprise a mesh.

Figure 3:
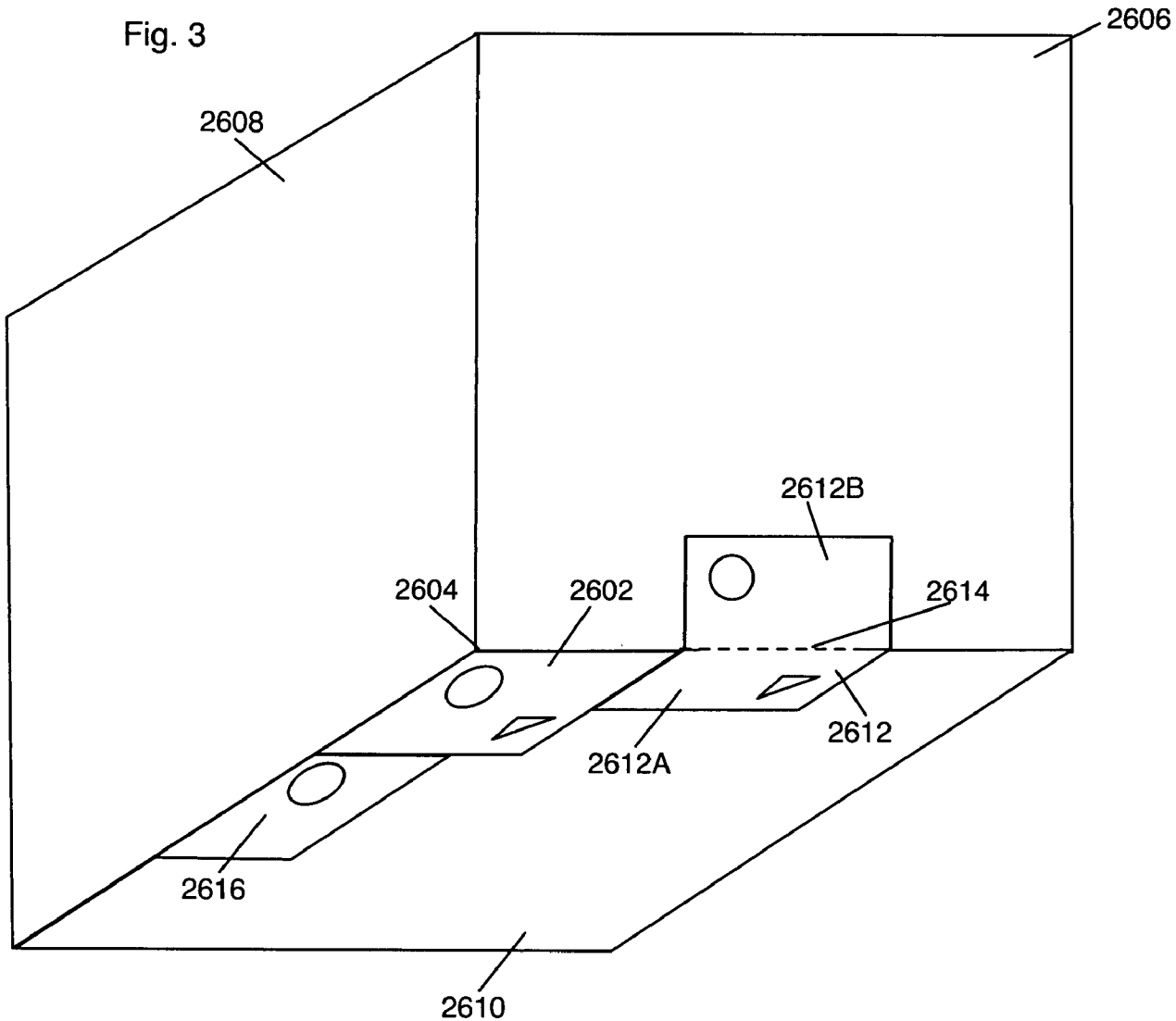
FIG. 3 is an illustration of how the design device illustrated in FIG. 1 may be used with other such devices.

FIG. 3 shows how a first stencil 2602 may be used in a room alone or with other stencils. Illustratively, the first stencil 2602 is shown positioned at corner 2604 formed by walls 2606 and 2608 and a floor 2610. The first stencil 2602 is placed on the floor 2610 so that the décor product may be deposited onto the first stencil 2602 for decorating the floor 2610. A second stencil 2612 has been folded along a line 2614 so that a first portion 2612A of the second stencil 2612 rests on the floor 2610 and a second portion 2612B thereof is supported by the wall 2606. The décor product may be applied to the first portion 2612A of the second stencil 2612 to decorate the floor 2610. If desired, the décor product may be applied to the second portion 2612B of the second 2612 to decorate the wall 2606. A third stencil 2616 has been cut and positioned on the floor 2610 adjacent the wall 2608. The gridlines 2216, 2218 printed on the stencils as described above may be used to as guides for positioning the first stencil 2602, the second stencil 2612, and third stencil 2616 with respect to each another. Also, the gridlines 2216, 2218 printed on the stencils may be used as guides for folding or cutting the stencils. In some embodiments, the top surface of the stencil is writable using a pen or pencil and a user may add guides thereon that may be used for positioning, folding, or cutting.

Although not shown, in some embodiments, a web of material used for the absorptive layer 2230 is laminated with the material used for the attachment and barrier layer 2232 to form a first laminated web. Similarly, a web of the material used for the structured layer 2234 is coated with the material used for the low-slip and flatness coating layer 2236 to form a second laminated web. Thereafter the first and second laminated webs may be introduced into a production line that includes a bonding unit for joining the first and second laminated webs together into a web of stencil material. The bonding unit may include a heating unit to activate the adhesive in the attachment and barrier layer 2232. Alternately, the bonding unit may include a pressure unit that activates the adhesive. A combination of heat and pressure may also be used. Other ways of joining the first and second laminate webs to form the web stencil material known in the art may be used. For example, an embodiment of the stencil 2210 comprises a non-woven absorptive layer 2230 laminated (for example, via poly coating, extrusion application, or extrusion lamination using molten polymer) using an attachment and barrier layer 2232 to a 16-18 point paperboard structured layer 2234 substrate that is poly-coated to form a low-slip flatness layer 2236 on an exterior surface. Such embodiment may provide a liquid barrier and a degree of surface tension when placed on a soft surface reduce movement of the stencil during application of the décor product. The production line may include embossing units to emboss the top surface of the web of stencil material (for example, if the absorptive layer had not been embossed prior to forming the first laminated web). Die cutting units in the production line may be used to form regularly spaced cutouts in the web of stencil material and sheeting units may be used to cut the web of stencil material into individual stencils.

In some embodiments, a roll uncoated paperboard that comprises the structured layer 2234 may be extrusion laminated to a roll of non woven material, which comprises the absorptive layer 2230, using molten polyethylene, which comprises the attachment and barrier layer 2232. The laminated material may thereafter be wound up onto a master roll. The master roll may coated on the paperboard side with molten polyethylene, which forms the low-slip and flatness layer 2236, and the coated material may be wound up onto a roll to form a coated master roll. The coated master roll may thereafter be cut into stencil sized sheets (for example, about 20-inches square) and stacked in columns. The stacked columns of cut sheets may thereafter be cut, for example on a flat bed die-cutting machine, to form the cutout portions of the stencil. In other embodiments, the coated master roll may be cut into sheets larger than the stencil and such sheets may be later trimmed to a final size.

Further embodiments of the present disclosure may incorporate value adding chemistries including powder coatings, toner and/or ink chemistries, carpet stain removers and/or maskers, odor eliminators and/or absorbers, bleaching agents. Compositions, methods of carpet stain removing and/or masking, methods of composition affixation, design aids, including stencils, and dispensing devices useful in the present disclosure include those disclosed in U.S. Patent Application Nos. 2007/0014921, 2007/0089621, 2006/02288499, and 2006-0276367, each filed on Jun. 6, 2006, and and filed on the same day as the present application, the disclosures of which are herein incorporated by reference. Further, technologies used in aftermarket carpet dyeing in the automotive industry may be useful in the present disclosure, including, for example, the "Pro Dye System" available from Top of the Line. An additional contemplated chemistry includes ultraviolet radiation cross-linking agents that crosslink décor product particles in preparation for affixation of the décor product to a surface or removal therefrom.

INDUSTRIAL APPLICATION

The apparatus of the present disclosure describes stencils useable for the application of a décor product to be applied to a surface, and more specifically a soft surface such as a carpet, a rug, draperies, curtains, upholstery, and the like. By applying the décor product to the soft surface, perceived aesthetic quality of the soft surface is improved and may extend the useful life of the soft surface before need for replacement.

The disclosure has been presented in an illustrative manner in order to enable a person of ordinary skill in the art to make and use the disclosure, and the terminology used is intended to be in the nature of description rather than of limitation. It is understood that the disclosure may be practiced in ways other than as specifically disclosed, and that all modifications, equivalents, and variations of the present disclosure, which are possible in light of the above teachings and ascertainable to a person of ordinary skill in the art, are specifically included within the scope of the impending claims. All patents, patent publications, patent applications, and other references cited herein are incorporated herein by reference in their entirety.

What is claimed is:

1. A stencil for applying a design to a desired surface, the stencil comprising:

a first layer having an embossed top surface and a bottom surface, the first layer comprising an absorptive non-woven base comprising a blend of a natural material and/or a synthetic material;

a second layer having a top surface and a bottom surface, the top surface of the second layer attached to the bottom surface of the first layer;

a third layer having a top surface and a bottom surface, the top surface of the third layer attached to the bottom surface of the second layer, the third layer comprising a structured material;

a fourth layer having a top surface and a bottom surface, the top surface of the fourth layer attached to the bottom surface of the third layer, the bottom surface of the fourth layer having an average static coefficient of friction of about 0.3 to about 0.8 and an average kinetic coefficient of friction of about 0.2 to about 0.8 as measured against a bottom surface having the same bottom surface as the fourth layer and one or more cutout portions that extend through the first through the fourth layers that allow passage of a material therethrough to apply the design to the desired surface.

2. The stencil of claim 1, wherein the non-woven base comprises at least one material selected from the group consisting of pulp, paper, synthetic fibers, cotton, cotton fabrics, rayon, and polyester.

3. The stencil of claim 1, wherein the first layer is hydro-embossed.

4. The stencil of claim 1, wherein the blend comprises from about 50% to about 90% rayon and from about 10% to about 50% polyester.

5. The stencil of claim 1, wherein the blend comprises about 70% rayon and about 30% polyester.

6. The stencil of claim 5, wherein the second layer comprises a liquid impervious material.

7. The stencil of claim 6, wherein the liquid impervious material comprises polyethylene.

8. The stencil of claim 1, wherein the third layer comprises a cellulosic material.

9. The stencil of claim 1, wherein the structured material comprises a material selected from the group consisting of cardboard, paper, a polymer based film, a polymer based foam, a foil film, semi-stiff nonwoven, needle punched nonwoven, poly-coated nonwoven, corrugated board, and combinations thereof.

10. The stencil of claim 9, wherein the third layer comprises about 12 to about 22-point paperboard.

11. The stencil of claim 10, wherein the fourth layer comprises a coating applied to the paperboard.

12. The stencil of claim 11, wherein the coating applied to the paperboard comprises polyethylene.

13. The stencil of claim 12, wherein between about 7 to about 10 pounds of the polyethylene are applied per 100 square feet of the paperboard.

14. A stencil for applying a design to a desired surface, the stencil comprising:

a first layer having an embossed top surface and a bottom surface, the first layer comprising an absorptive non-woven base comprising a blend of a natural material and/or a synthetic material;

a second layer comprising a liquid impervious top layer that comprises a cellulosic material and a bottom low-slip layer comprising polyethylene and having a static coefficient of friction that is between about 0.2 to about 1.2 and a kinetic coefficient of friction that is between about 0.1 to about 1.1 as measured against a bottom surface of another surface having the same bottom surface as the second layer; and one or more cutout portions that extend through the first and second layers and allow passage of a composition therethrough to apply the design to the desired surface.

15. The stencil of claim 14, wherein the non-woven base comprises at least one material selected from the group consisting of pulp, paper, synthetic fibers, cotton, cotton fabrics, rayon, and polyester.

16. The stencil of claim 14, wherein the first layer is hydro-embossed.

17. The stencil of claim 14 further comprising a third layer disposed between the first and second layers and comprising an adhesive to adhere the liquid impervious top layer to the bottom surface of the first layer.

* * * * *